United States Patent [19]

Leininger et al.

[11] 4,175,550

[45] Nov. 27, 1979

[54] THERAPEUTIC BED

[76] Inventors: James R. Leininger; John H. Vrzalik, both of 3417 Steen, San Antonio, Tex. 78219

[21] Appl. No.: 890,457

[22] Filed: Mar. 27, 1978

[51] Int. Cl.[2] ..... A61H 1/00

[52] U.S. Cl. ..... 128/24 R; 128/33; 5/109

[58] Field of Search ..... 128/24 R, 33, 49, 56; 5/60, 61, 109

[56] References Cited

U.S. PATENT DOCUMENTS

| | | | |
|---|---|---|---|
| 2,534,471 | 12/1950 | Norheim | 128/24 R |
| 2,667,169 | 1/1954 | Kambourakis | 128/24 R |
| 3,235,891 | 2/1966 | Chade et al. | 128/33 UX |
| 3,662,747 | 5/1972 | Williams | 128/24 R |
| 3,737,924 | 6/1973 | Davis | 5/61 |
| 4,071,916 | 2/1978 | Nelson | 5/109 |

*Primary Examiner*—L. W. Trapp

*Attorney, Agent, or Firm*—Cox, Smith, Smith, Hale & Guenther

[57] ABSTRACT

A bed for immobilized patients and method for adjusting such a bed comprising a motor-driven, oscillating patient support platform mounted for longitudinal rotation about axes spaced above the platform at a predetermined distance and having a counter balance keel extending below the platform for attachment of varying counter balance weights, and having a slip clutch set to slip when the counter balance weights do not balance with a patient's weight.

14 Claims, 10 Drawing Figures

THERAPEUTIC BED

BACKGROUND OF THE INVENTION

The invention relates to therapeutic beds, and more particularly, to hospital beds for use by chronic patients, such as patients who are partially or fully paralyzed, patients suffering from head injuries, from multiple sclerosis, fractured spines, and similar serious injuries, which either render the patient incapable of voluntary movement or necessitate restriction of their movements.

When a formerly normal, active person is confined to bed because of illness or injury, reduction in normal exercise produces such problems as constipation, muscle wasting, bone decalcification and bed sores. In addition, if the patient through paralysis, loss of consciousness or loss of sensitivity to pain, fails to turn themselves or shift their weight in bed with a minimum frequency, threatening complications such as hypostatic pneumonia, venous thrombosis in the lower limbs, and ducubiti may result.

The greatest portion of the human body is muscle and bone and movements such as walking, running, climbing and physical work is very important to the maintenance of a healthy human organism. The human body improves with use and deteriorates with lack of exercise. In humans, there is a minimum degree of activity below which serious degeneration results. In fact, movement of the human body is of such fundamental importance that even during sleep a normal healthy adult changes his position on an average of every eleven and a half (11.5) minutes.

So far as known, prior art hospital beds have several inherent deficiencies that are overcome by the present invention. For example, U.S. Pat. No. 3,434,165 discloses an intensive care therapeutic bed for treating acute patients requiring constant attention and personal care. It is also possible that this bed could be utilized for the treatment of chronic patients not requiring constant attention and treatment. The bed is provided with a patient supporting platform comprising a plurality of hatches to enable an attendant to gain access to all parts of a patients body for the purpose of treatment and manipulation of the individual limbs. The patient support platform is mounted for control of oscillatory movement relative to a bed support means. In order to allow the hatches to swing open, it was necessary to provide structural support for the patient support means by use of a U-shaped structural keel which transmitted the load of the patient support platform to the pivot points at each end of the bed support platform, thereby enabling the hatches to be swung down unencumbered by any underlying support member. The weight of the keel extending below the longitudinal center line of the patient support platform acted as a counterbalance in the same manner as the keel of a sailboat to prevent the bed from tipping over when the patient support platform with the patient thereon was rotated to an extreme position.

As a patient progresses from the acute to the chronic stage, the requirement for stringent mobilization is less essential and a simpler type of hospital bed than that disclosed in U.S. Pat. No. 3,434,165 can be desirably used. The plurality of hatches with the patient support platform may be reduced leaving only a rectal hatch, thus eliminating the requirement of a continuous longitudinally extending U-shaped structural support keel.

However, the requirement for continuous oscillatory movement of the patient support platform is perhaps even intensified. Since the patient is not receiving constant personal attention from an attendant, and in many instances might be confined to their own home, it is most important that the patient support platform function as reliably and trouble free as possible. The present invention is intended to satisfy this requirement and in this regard, it is of utmost importance that the patient support platform oscillate continuously to the full extent of its rotating arc with minimum energy usage and motor wear. When a patient is left unattended for long periods of time, it is also essential that a greater factor of safety from tipping of the bed be provided. Since the patient is not completely immobilized and must therefore be moved from the bed more frequently for various treatments and the like, it is desirable that the attendant be able to maneuver the patient from the platform with relative ease and without assistance.

SUMMARY OF THE INVENTION

The bed of the present invention comprises a patient support platform mounted for oscillatory rotation on a bed support means. A partial keel extends downwardly below the patient support platform for removably securing counter balance weights thereto. The center of gravity of the bed can be adjusted to compensate for varying patient weight, as well as for an empty bed by selectively fastening counter balance weights to the keel. The patient support platform is operatively connected to a drive motor through a slip clutch so that an unbalanced condition will result in the clutch slipping, thus eliminating the excessive loads on the drive motor and will also signal an out of balance condition. The slip clutch will remain engaged enabling the motor to control the oscillation of the platform with minimal wear and energy consumption when the appropriate counter balance weights for the size and weight of the patient are affixed to the keel. The bed may be manually rotated by an attendant by merely forcing the bed to the desired position by overriding the slip clutch.

Elevators are provided on each end of the patient support platform for raising and lowering and tilting of the platform relative to the bed support means. The elevators include linear actuators on each end of the bed support means connected to the patient support platform. Dual control means are provided to raise and lower or to tilt the platform. The patient support platform may be locked into a desired position by inserting a retaining pin assembly into one of a plurality of apertures spaced along an arcuate plate at one end of the patient support platform. The retaining pin assembly is operatively connected to a microswitch to disengage the oscillatory motor upon insertion of the pin into a desired aperture to lock the patient support platform at a desired position.

DETAILED DESCRIPTION OF THE PREFERRED EMBODIMENT

Figure 1:
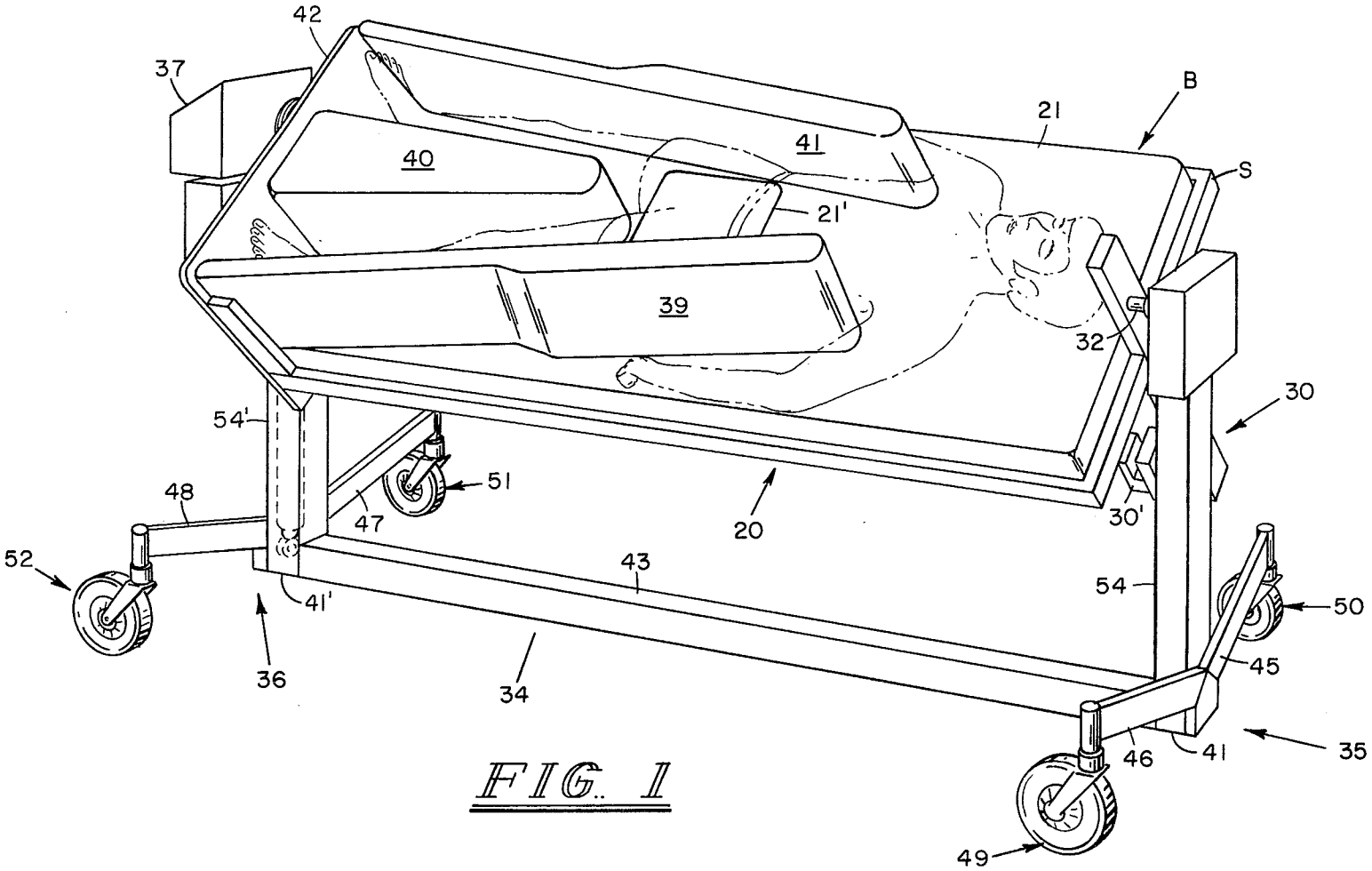
FIG. 1 is a perspective view of a hospital bed according to the invention showing a patient in broken lines positioned thereon.
Figure 8:
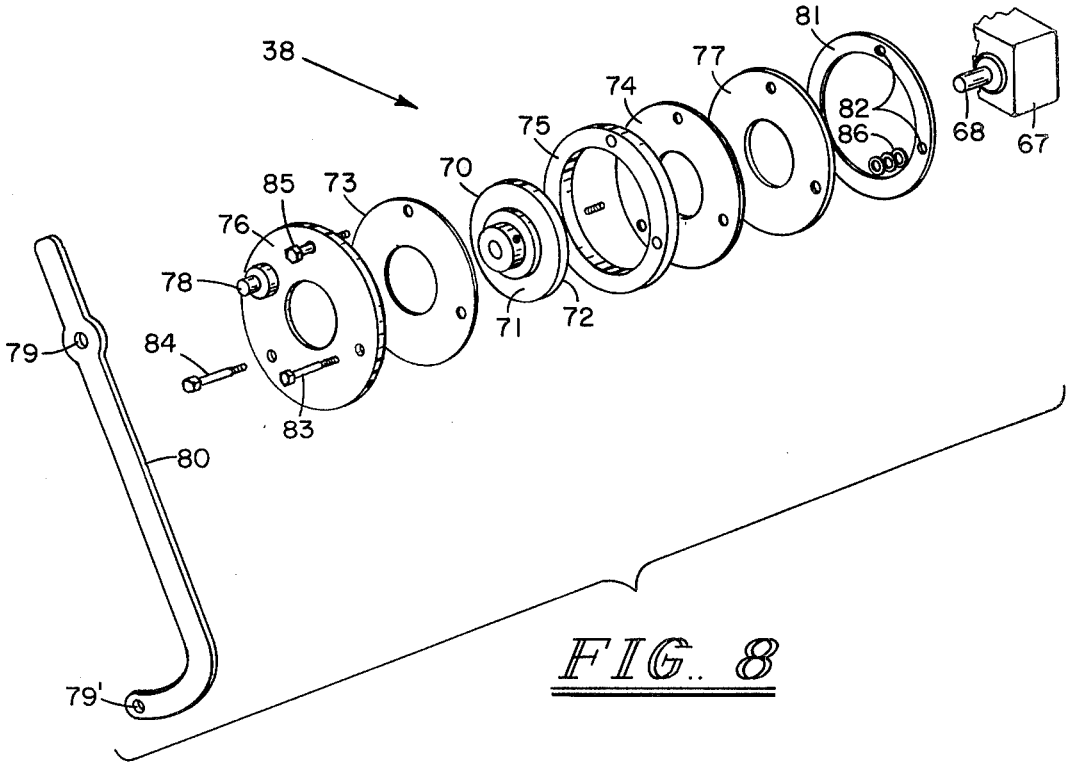
FIG. 8 is an exploded view of the crank arm and slip clutch assembly.
Figure 9:
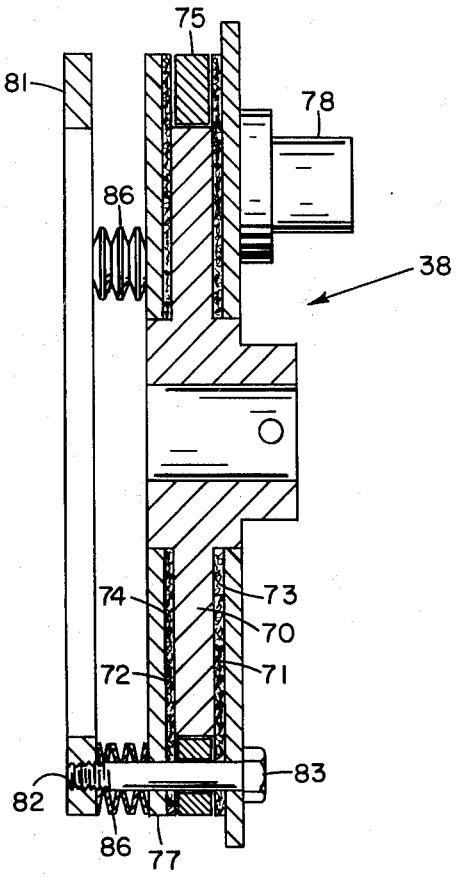
FIG. 9 is a cross-sectional view of the assembled slip clutch assembly.

Referring to FIG. 1 of the drawings, there is shown a preferred embodiment of the therapeutic bed B of the invention. The bed includes a patient support platform 20, which platform is mounted with counterbalance keel means 30 and 31. The keel means 30 and 31 are mounted for rotation about pivot axes 32 and 33, respectively, which pivot axes are positioned at a predetermined distance above the patient support surface S on the patient support platform. The bed further includes a U-shaped support frame 34, having telescoping members 35 and 36 mounted at each end for vertical movement of the bed. The pivot axes 32 and 33 are mounted with the telescopic members 35 and 36 so that extension and retraction of the telescopic members results in raising and lowering of the patient support platform 20. Mounted on the telescopic member 36 is a drive means 37 which includes a slip clutch means 38, as best shown in FIGS. 8 and 9 for oscillating the patient support platform.

Figure 2:
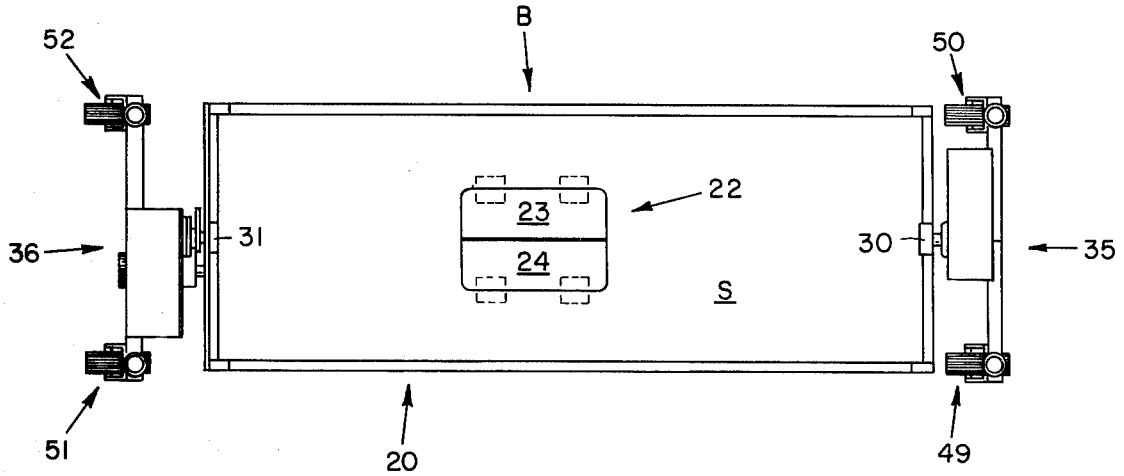
FIG. 2 is a top view of the hospital bed.
Figure 3:
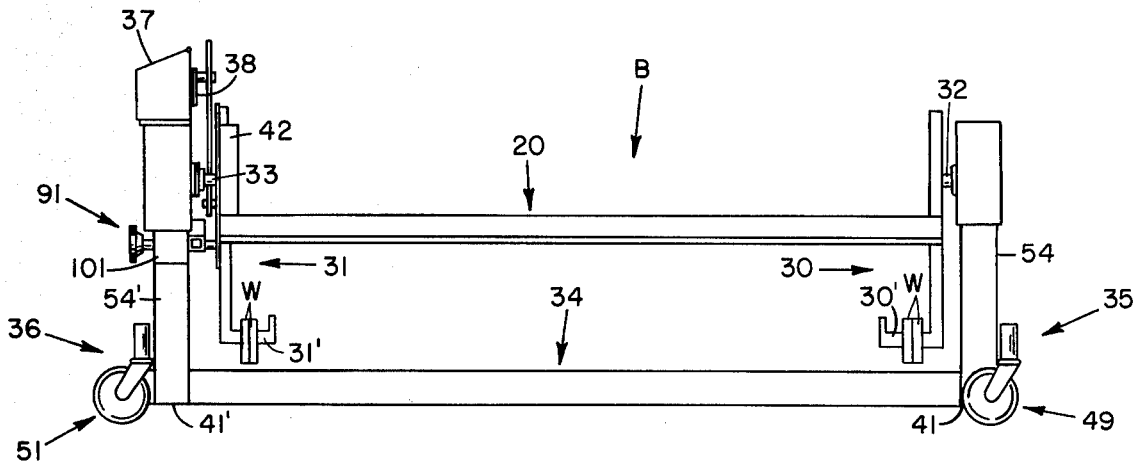
FIG. 3 is a side elevation view of the hospital bed.

Referring again to FIG. 1 of the drawing, the patient is shown in broken lines on the patient support surface S. The leg and side supports 39, 40 and 41 and foot support member 42 are provided to prevent the patient from falling off the bed when the bed is in a tilted position as shown in FIG. 1. The use of leg and side support means on therapeutic beds is old and well known in the art and reference is made to U.S. Pat. No. 3,434,165 issued to F. X. Keane, which patent is incorporated herein in toto by specific reference thereto. The patient support platform 20 has a suitable mattress 21 for maintaining the comfort of the patient. A rectal hatch 22, having releasable doors 23 and 24, is provided for providing access to the rectal region of the patient. Releasable fasteners are provided (not shown) to maintain the doors closed, as shown in FIG. 2, and to allow release of the doors for access to the patient. It is understood that the mattress 21 has a cut out portion 21′ over the doors 23 and 24, so that the cut out portion can be moved out of the way when the doors 23 and 24 are unlatched. A suitable pan or the like could also be mounted with the rectal hatch 22 as desired.

A U-shaped support frame 34 includes a longitudinally extending beam 43 with a vertical member 54 extending upwardly therefrom at the head end of the bed and a vertical member 54′ extending upwardly therefrom is at the foot end of the bed. The beam 43 has openings 41 and 41′ through the underneath side of the beam on either end thereof, said openings being aligned with the vertical beams 54 and 54′. Pivot wheel support assemblies 35 and 36 consist of outwardly extending leg supports 46, 45, 47 and 48, rigidly secured to vertical support beams 53 and 53′, respectively.

Figure 10:
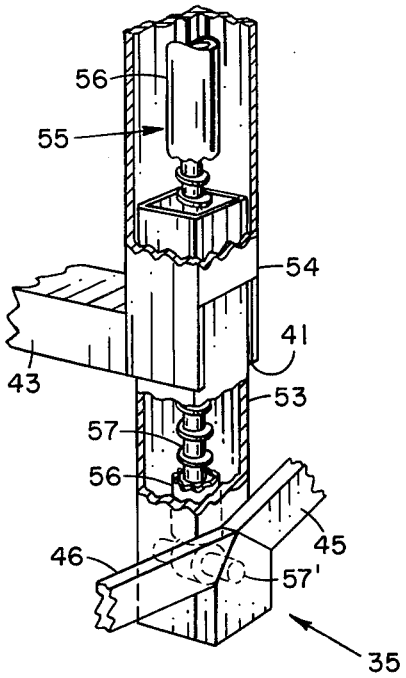
FIG. 10 is a broken cross-sectional view showing an elevator on one end of the bed.

As best shown in FIG. 10, the wheel support assembly 35 is arranged in telescoping engagement with the U-shaped support frame 34 with the vertical support beam 53 extending through opening 54 into telescoping, sliding engagement inside of vertical member 54. A screw type elevator 55 is mounted between the telescopic beams 53 and 54 so that rotation of the male screw member 57 relative to the female screw member 56 causes the support beams 53 and 54 to telescope, which in turn raises and lowers the patient support platform 20. A second screw type elevator 58, having rotating male member 60 and stationary female member 59 is provided at the foot of the bed, for likewise lowering and raising the foot of the bed as desired. The female members 56 and 59 are secured to the wheel support assemblies by pins 57′ and 60′. The elevators 55 and 58 are secured with the upper support beams 54 and 54′ with suitable fastening means such as pin 59′. The drive mechanism for the male screw members 57 and 60 are identical, so reference is made to FIG. 7 for its complete description of the elevator drive means for the foot of the bed.

The elevator drive means includes a gear means 61 which is driven by a reversible motor 62. Energizing of the motor 62 causes the male screw 60 to rotate in either direction, so as to raise and lower the foot of the bed. A switch 65 is provided for simultaneously energizing the elevator motors in the same direction at the foot and head of the bed so as to raise and lower the bed uniformly. An individual switch 64 is provided to activate motor 62 at the foot of the bed and the motor (not shown) at the head of the bed simultaneously in opposite directions to raise and lower the head and foot of the bed.

Figure 6:
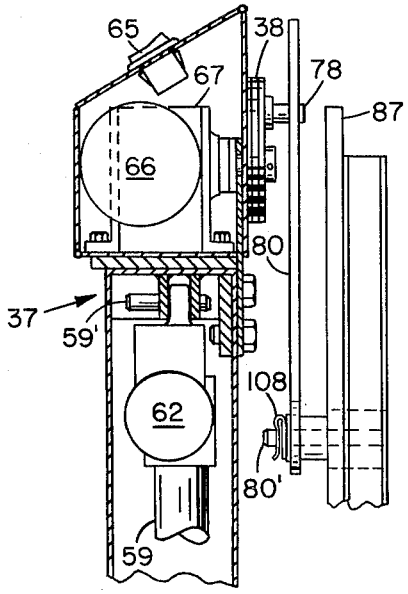
FIG. 6 is a view taken along line 6—6 in FIG. 4.
Figure 7:
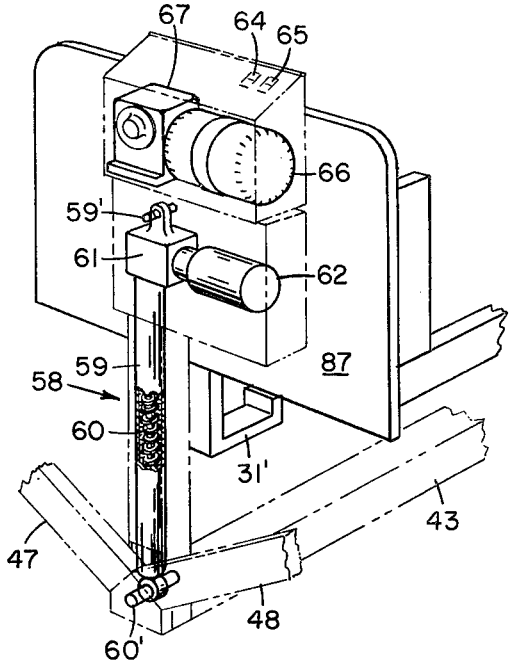
FIG. 7 is a phantom view showing the control panel and an elevator on one end of the bed.

The drive means 37 is best shown in FIGS. 6 and 7. It includes a motor 66 and gear means 67. The gear means 67 includes an output shaft 68, to which is mounted the slip clutch means 38. The details of the slip clutch mechanism are best shown in FIG. 8. The slip clutch 38 includes a rotor 70 which may be rigidly secured to the output shaft 68 by suitable means such as a key (not shown). The rotor 70 includes annular friction faces 71 and 72 for engagement by friction discs 73 and 74. An inner container ring 75 is provided to maintain the rotor centered relative to the discs 73 and 74. The container ring 75 has a lesser thickness than that of the rotor 70, so that the faces 71 and 72 will engage the friction discs 73 and 74. Support discs 76 and 77 are provided to engage and support the friction discs 73 and 74. A pivot axis 78 is secured with the support disc 76 for insertion in the opening 79 in the crank arm 80. The crank arm 80 includes a second opening 79′ for receiving pin 80′ (FIG. 6). An annular ring 81 is provided which includes tapped openings 82 therethrough. Bolts 83 84 and 85 are provided, which insert through the openings in the support discs 76 and 77, friction discs 73 and 74, and container ring 75. The bolts 83, 84 and 85 are screwed in the tapped openings 82 in the annular ring 81. A plurality of spring discs 86 are provided so that the amount of friction between the friction discs 73, 74, rotor faces 71, 72 may be adjusted. As best shown in FIG. 9, adjustment of the bolts 83, 84 and 85 tightens the support discs against the friction discs and rotor so as to increase the amount of friction which is necessary to be overcome in order for the rotor 70 to rotate relative to the support discs 76 and 77. This provides a slip clutch action which will be explained more fully hereinafter.

Figure 4:
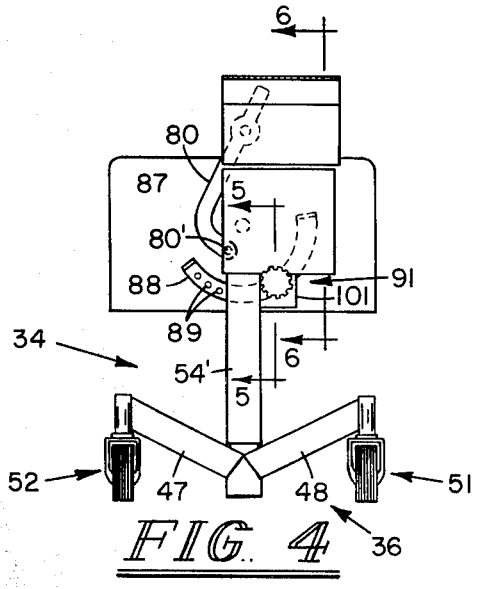
FIG. 4 is an end elevation view showing the control mechanism.
Figure 5:
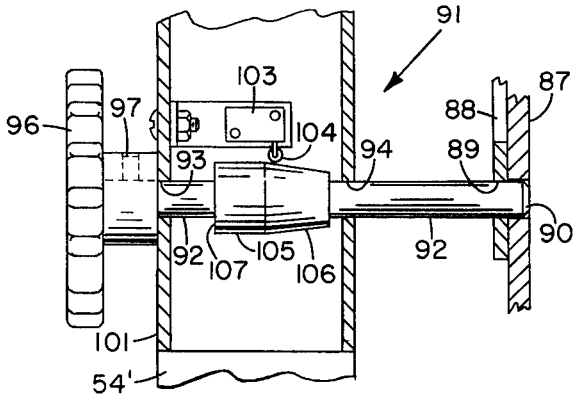
FIG. 5 is a broken cross-sectional view of the locking pin and power control switch.

A plate member 87 is mounted at the foot of the bed which plate member includes an arcuate reinforcing plate 88 having a plurality of apertures 89 extending therethrough, as best shown in FIGS. 4 and 5. Plate member 87 also includes openings 90 coinciding with the openings 89. Secured with the telescoping member 36 is a locking pin assembly 91, as best shown in FIG. 5. The locking pin assembly 91 includes a reciprocating pin 92, reciprocally mounted in openings 93 and 94 in support walls 100 and 101, respectively.

The microswitch 103 is mounted with the wall 101 and includes a contact member 104. The pin 92 includes a camming bushing 105 having a camming surface 106 which the contact member engages. When the control knob 96 is pushed inwardly to the position shown in FIG. 5, so that the pin 92 engages the apertures 89 and 90 to lock the bed, the contact member 104 slides along the camming surface 106 and is pushed upwardly as viewed in FIG. 5 to deactivate the microswitch 103 which deactivates the motor 66 which rotates the patient support platform. Accordingly, the patient support platform may be locked in any position by inserting the pin 92 in the desired apertures in the arcuate reinforcing member and plate member. When it is desired to energize the drive motor 66, the control knob 96 may be grasped to pull the pin 92 from an aperture, which returns the knob to its normal position, wherein the end surface 107 of the camming bushing engages the support wall 101. The microswitch provides a safety feature so that if the bed is locked, it will deenergize the motor 66.

METHOD OF OPERATION

The method of operating the bed B is described more fully as follows. The distance between the position of the pivot axes 32 and 33 from the patient support surface S is such as to coincide with approximately the center of gravity of the patient on the patient support surface. The distance is preset to coincide with a predetermined weight for the patient, which may, for example, be 160 pounds. The keel means 30 extends downwardly below the patient support surface S and includes weight support arm 30′ and 31′ for the selective positioning of weights W thereon. With a patient in position on the bed, the motor 66 is activated so as to begin the oscillation of the patient support platform. The slip clutch 38 is preset so that when a predetermined number of weights W is mounted on the weight support arms 30′ and 31′, then no slippage of the slip clutch will occur, for example, when a patient weighing 160 pounds is positioned on the bed for continuous oscillating of the bed. If the patient on the bed does not weight a sufficient amount, when the crank arm 80 tries to cause the patient support platform to operate, then the slip clutch will slip when the bed reaches a certain point. This indicates that too much weight is provided on the weight support arms for the keel means and the weights must be adjusted so that unnecessary strain on the drive means is prevented. On the other hand, when a patient on the patient support surface is greater than the optimum amount of weight, then when the bed rotates to its greatest extent for its 120° arc of rotation, then the bed will tend to remain in this position with the slip clutch slipping. In such circumstances, it is necessary to add additional weight to the weight support arms on the keel means, so as to adjust the bed again, so that the bed is properly balanced for the weight of the patient thereon. This allows the use of this bed in many different instances, regardless of the size and the weight of the patient, so that the bed can be adjusted to each patient.

Also, in the event that an attendant or nurse wishes to place the bed in a desired position, it is not necessary to wait until the crank 80 turns the bed to the desired position but rather the bed may be grasped and forced to rotate to the desired position through slippage of the slip clutch 38. disengaging opening 79 of the crank 80 removing It would be possible to remove the disengaging opening 79 of It would be possible to remove the 80, such as by disengaging opening 79 of the crank 80 from the pivot axis 78. However, this has the disadvantage that the bed then will freely swing due to gravity, which may not be desirable should the patient have a greater weight than the optimum amount for the bed. It is necessary that the rotating patient support platform be well balanced in order for a nurse or attendant to manually rotate the bed through slippage of the slip clutch 38. The compression in the washers 86 is such that the manual slippage of the slip clutch can occur when desired.

While there has been shown and described a preferred embodiment of a therapeutic bed in accordance with the invention, it will be appreciated that many changes and modifications may be made therein without, however, departing from the essential spirit of the invention within the scope of the claims.

We claim:

1. A therapeutic bed for immobilized patients, comprising:
   - a motor-driven oscillating patient support platform mounted for longitudinal rotation about longitudinally extending axes;
   - a counter balance keel means extending below the patient support platform for mounting counter balance weight means to minimize unbalancing of the bed due to a patient resting on the patient support platform; and
   - a slip clutch means connecting the motor with the oscillating patient support platform and set to slip at a predetermined value when the counter balance weight means does not balance with the weight of a patient on the patient support platform.

2. The therapeutic bed as set forth in claim 1, wherein:
   - the longitudinally extending axes are spaced above the patient support platform at a predetermined distance to facilitate balancing of the bed with a patient on the patient support platform.

3. The therapeutic bed as set forth in claim 1, wherein:
   - the counter balance keel means includes at least one keel extending below and partially under the patient support platform for mounting counter balance weight means on the partially under extending portion.

4. The therapeutic bed as set forth in claim 3, wherein:
   - the counter balance keel means includes keels at each end of the patient support platform extending below and partially under the patient support platform for mounting counter balance weight means on the partially under extending portion.

5. The therapeutic bed as set forth in claim 1, wherein:
   - the keel means includes a keel at each end of the patient support platform for mounting counter balance weight means.

6. The therapeutic bed as set forth in claim 1, wherein:
   - the slip clutch is set to slip at a predetermined value to allow an attendant to rotate the patient support platform to any desired position for access to a patient without waiting for the drive motor to rotate the patient support platform.

7. The therapeutic bed as set forth in claim 1, wherein:

the slip clutch has adjusting means for setting the amount of force necessary to cause it to slip at a predetermined value.

8. The therapeutic bed as set forth in claim 1, including:

a locking means for locking the patient support platform at a predetermined position to prevent oscillation.

9. The therapeutic bed as set forth in claim 8, wherein:

the locking means includes a switch for deactivating the drive motor when the patient support platform is locked at the predetermined position.

10. The therapeutic bed as set forth in claim 1, including:

individually vertical adjusting means at each end of the patient support platform for inclining the patient support platform to a desired inclination.

11. A method of balancing a motor-driven oscillating therapeutic bed to a patient's weight comprising the steps of:

setting a motor slip clutch connecting a drive motor to an oscillating patient support platform to slip at a predetermined value;

mounting a keel having adjustable counter balance weight means extending below the patient support platform for minimizing imbalancing of the patient support platform and to prevent slippage of the slip clutch when the counter balance keel means balances with the weight of a patient on the patient support platform.

12. The method as set forth in claim 11, including the step of:

adjusting the counter balance weight means to balance the counter balance keel means with the weight of a patient on the patient support platform.

13. The method as set forth in claim 11, including the step of:

setting the motor slip clutch to slip at a predetermined value to allow an attendant to rotate the patient support platform to any desired position for access to a patient without waiting for the drive motor to rotate the patient support platform.

14. A method of balancing a motor-driven therapeutic bed having a slip clutch set to slip at a predetermined value connecting a drive motor to an oscillating patient support platform and a counter balance keel means extending below the patient support platform, comprising the steps of:

positioning a patient on the oscillating patient support platform; and adjusting weight means on the counter balance keel means to minimize unbalancing of the patient support platform and to prevent slippage of the slip clutch when the counter balance keel means balances with the weight of a patient on the patient support platform.

* * * * *